United States Patent [19]

Stone

[11] 4,225,089

[45] Sep. 30, 1980

[54] FLUID FLOW MANIFOLD

[75] Inventor: Alan M. Stone, Briar Hill, Australia

[73] Assignee: Sphere Investments Limited, Nassau, The Bahamas

[21] Appl. No.: 954,915

[22] Filed: Oct. 26, 1978

[30] Foreign Application Priority Data

Nov. 11, 1977 [AU] Australia ..... PD2381

[51] Int. Cl.[3] ..... B05B 1/14

[52] U.S. Cl. ..... 239/562; 239/567

[58] Field of Search ..... 239/551, 562, 563, 566, 239/567

[56] References Cited

U.S. PATENT DOCUMENTS

| | | | |
|---|---|---|---|
| 1,572,915 | 2/1926 | Fricker | 239/551 |
| 3,072,148 | 1/1963 | Carls . | |
| 3,195,572 | 7/1965 | Carls . | |
| 3,384,114 | 5/1968 | Hathaway et al. . | |
| 4,081,141 | 3/1978 | Courson et al. | 239/551 |

*Primary Examiner*—Robert W. Saifer

*Attorney, Agent, or Firm*—Cushman, Darby & Cushman

[57] ABSTRACT

A fluid flow manifold to deliver pressurized fluid to a series of outlets from a common supply duct has a block body and fluid outlets disposed in linear array along one side of the block. Valves are spread over an opposing side of the body block and connected to the fluid outlet by outlet ducts extending transversely through the block. A supply duct extends longitudinally through the block and delivers fluid to the valves via transfer ducts. The valves are spread in cylindrical array about an axis extending along the linear array of outlets and the outlet ducts converge radially to converge into a linear array defining the fluid outlets such that lengths of all outlet ducts between the valves and the fluid outlets are equal.

9 Claims, 3 Drawing Figures

FLUID FLOW MANIFOLD

BACKGROUND OF THE INVENTION

This invention relates to fluid flow manifolds for delivering fluid to a plurality of outlets.

The invention has particular, but not exclusive application, to ore sorting apparatus of the type in which ore rocks are projected in free flight past an array of fluid blast nozzles which deliver fluid jets or blasts of short duration to deflect selected rocks from the free flight trajectory so that the deflected and undeflected rocks can be collected in separate bins. In apparatus of this type a large number of closely spaced nozzles may be required and the flow to each nozzle must be individually controlled by a separate valve. It then becomes difficult to position all of the valves adjacent the nozzles because of the bulk of the valves and it is usual to mount the valves on a separate frame and to connect them to the nozzles by flexible piping. This results in a complicated entanglement of piping. Moreover, at least some of the valves will be located at varying distances from their respective nozzles whereas in order to ensure accurate timing of the fluid jet blasts and to minimise friction losses it would be most desirable to have an arrangement in which the delivery pipe from the valves to the nozzles were all of equal length and as short as possible. The present invention provides a novel type of fluid flow manifold which enables this to be achieved.

Although the invention has been devised in order to overcome the above problem in rock sorting apparatus it will be appreciated that there are other applications in which fluid must be delivered through individual valves to a plurality of outlets and it is to be understood that the manifold provided by the present invention may be used in such other applications.

SUMMARY OF THE INVENTION

According to the invention there is provided a fluid flow manifold having at one side a plurality of fluid outlets and at an opposing side a plurality of valve outlet ports each connected to one of the fluid outlets by a respective outlet duct, wherein:

said fluid outlets are disposed in a linear array;

said valve outlet ports are disposed in an array spreading circumferentially and longitudinally over an imaginary cylindrical surface curved about an axis of curvature extending longitudinally of the linear array of fluid outlets in the vicinity of those outlets; and said outlet ducts extend from the valve outlet ports radially of said imaginary cylindrical surface so as to converge into a linear array defining the fluid outlets such that the lengths of all outlet ducts between the valve outlet ports and the fluid outlets are substantially equal.

Said valve ports may be disposed in a plurality of lines each generally parallel with the linear array of fluid outlets and lying on said imaginary cylindrical surface.

The manifold may further comprise a fluid supply duct extending parallel with the linear array of fluid outlets between those outlets and the array of valve outlet ports, and a plurality of fluid transfer ducts radiating out from the supply duct to valve inlet ports adjacent the valve outlet ports, in which case at least some of the fluid outlet ducts may pass laterally through the fluid supply duct.

BRIEF DESCRIPTION OF THE DRAWING

In order that the invention may be more fully explained one particular embodiment will be described in detail in reference to the accompanying drawing, in which.

DESCRIPTION OF THE PREFERRED EMBODIMENT

Figure 1:
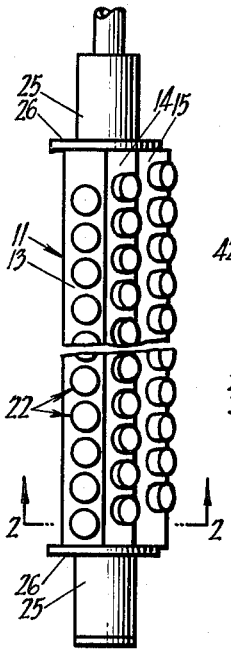
FIG. 1 is a top view of a fluid flow manifold constructed in accordance with the invention.

The illustrated manifold comprises an elongate, generally wedge-shaped, cast metal block 11. This block is of straight sided polygonal cross-section such that it has at one side a flat longitudinally extending rectangular face 12 and at the other side a set of three adjoining flat rectangular faces 13, 14 and 15 generally opposing the face 12. The set of flat faces 13, 14 and 15 extend between edge faces 16 and 17 of the block which converge toward the side face 12.

Faces 13, 14 and 15 are laterally inclined at small angles to one another so as to be cylindrically arranged about an imaginary axis 19 extending longitudinally through the block a short distance in from the side face 12.

Each of the block faces 13, 14 and 15 is machined with a line of blind holes or sockets which serve as valve chambers 21 for valves denoted generally as 22. The installation and operation of these valves will be described below.

A fluid supply duct 23 extends longitudinally through the center of manifold block 11. This duct is formed by a metal tube 24 which enters the block from one end and is closed off at the other end of the block. The ends of the block may be fitted with mounting collars 25 bolted to the block via flanges 26. A series of fluid transfer ducts 27 radiate outwardly from fluid supply duct 23 to communicate with the valve chambers 21 via valve inlet ports 28 in the bases of those chambers. There may be a pair of diametrically opposed inlet ports 28 in each valve chamber and a corresponding pair of transfer ducts 27 extending from those ports to the supply duct 23.

A series of fluid outlet ducts 29 extend transversely through block 11 from the valve chambers 21 to the side face 12 of the block. These outlet ducts are formed by tubes 31 which extend laterally through the supply duct 23 and project from the block end face 12 to form a linear array of projecting nozzle outlets 32. The other ends of tubes 31 define valve outlet ports 30 in the bases of the valve chambers 21 and they project into the valve chambers slightly to form spigot valve seats 33 surrounding those outlet ports.

Valves 22 comprise flanged housings 34 which close the outer ends of valve chambers 21. These housings are flange bolted to the respective block faces 13, 14 and 15 by studs 35 which screw into tapped holes 36 in those faces, gaskets 37 being sandwiched between the block faces and the housing flanges 38 to seal the valve chambers. Housings 34 contain conventional solenoid actuators to actuate valve plungers 39 which extend into the valve chambers 21. The ends of plungers 39 are fitted with seal facings 41 to engage the valve seats 33 surrounding the valve outlet ports 30 and, by appropriate operation of the solenoid actuators, plungers 39 can be actuated selectively to close or to open those outlet ports.

In operation of the manifold, valve chambers 21 are continuously charged with fluid under supply pressure, such fluid being delivered from supply duct 23 via the transfer ducts 27 and valve inlet ports 28, and the valves are selectively operable so any one or more of the valve outlet ports can be opened to cause fluid to be delivered via a respective outlet duct to each selected outlet nozzle.

Figure 2:
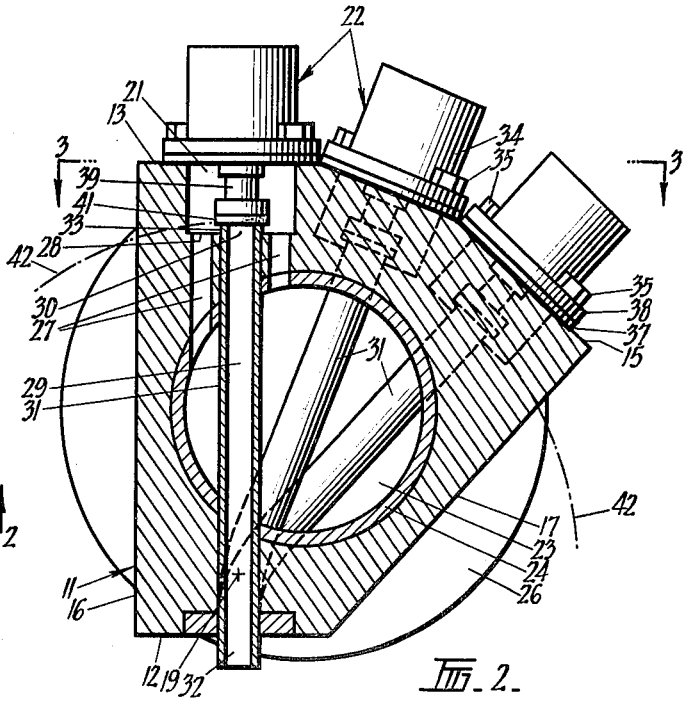
FIG. 2 is a cross-section on the line 2—2 in FIG. 1.
Figure 3:
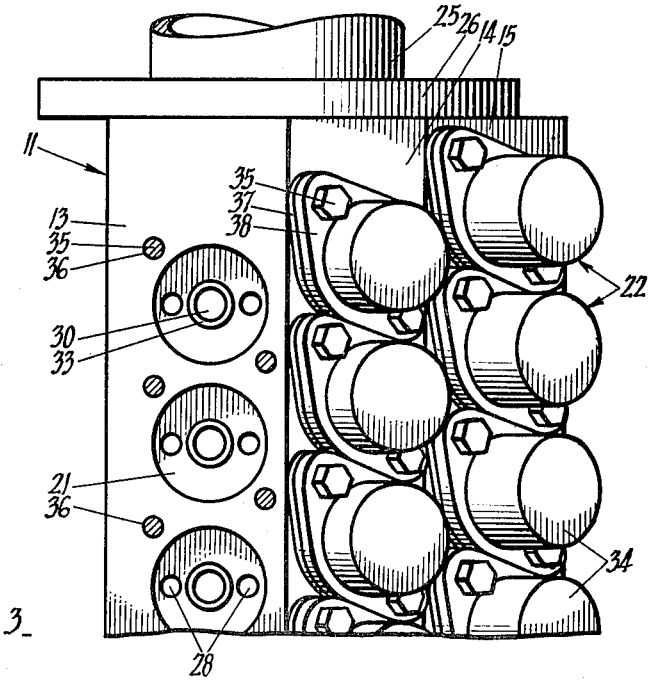
FIG. 3 is a view generally on the line 3—3 in FIG. 2.

Since valve outlet ports 30 are all spaced equally inwardly to the same extent from the respective block faces 13, 14 and 15 they are disposed on an imaginary cylindrical surface curved about the axis 19 in the vicinity of the fluid outlets 32. This imaginary surface is indicated by the broken line 42 in FIG. 2. The fluid outlet ducts 29 extend from valve outlet ports 30 radially of the cylindrical surface to converge at axis into a linear array of duct segments defining the outlets 32. Thus the lengths of all of the outlet ducts 29 between the valve outlet ports 30 and the fluid outlets 32 are precisely the same.

The valve chambers 21 and outlet ports 30 in each of the three lines along the block faces 13, 14 and 15 are spaced apart at a pitch distance equal to three times the pitch between successive fluid outlets 32. The three lines of valve chambers are staggered relative to one another in the longitudinal direction so that the chambers in face 14 are advanced from those of face 13 by $\frac{1}{3}$ of the valve pitch and the chambers in face 15 are similarly advanced from those of face 14. Thus the three lines of valve chambers together provide a succession of chambers (and associated outlet ports) separated in the longitudinal direction by the distance between the fluid outlets and the outlet ducts 29 are connected accordingly. In the illustrated arrangement the outlet ducts connected to the valve chambers in block face 13 are straight throughout their lengths and the intermediate ducts are bent at the convergance line (axis 19) to suit the positions of the chambers in faces 14 and 15. It will be appreciated, however, that the ducts extending to the chambers in face 14 or those extending to the chambers in face 15 could be straight and the others bent, or all ducts could be bent according to the direction of nozzle outlets 32.

The disposition of the valve chambers and the associated valve outlets in a cylindrical array in the manner illustrated permits a very compact arrangement in that the valves in each line are spaced apart by three times the spacing of the fluid outlet nozzles. The valves can be fitted in a close packed formation to control the flow of fluid through extremely short outlet ducts of equal length. Extension of the outlet ducts 29 laterally through the supply duct 23 further facilitates a compact arrangement and in the case where the operating fluid is highly compressed gas it also eliminates the problem of ice-formation in the outlet ducts due to the Joule-Thomson Effect on rapid expansion of the gas in those ducts, since the duct tubes also serve as heat transfer tubes whereby heat is extracted from the incoming supply gas in duct 23. Construction of the manifold is also simplified in that the tubes defining the supply duct and the outlet ducts can be initially fitted together and inserted into a mould to serve as a core around which the body block may be molded in a suitable metal such as aluminium. The ends of the outlet duct tubes defining the outlet nozzles may be held in accurate spacing and alignment during casting by a drilled Keeper plate 43 (FIG. 2) which then remains as an inlay in block face 12.

Although in the illustrated manifold there are three lines of valves it will be appreciated that it would be possible to have two, four or more such lines, the valve pitch spacing in each line being adjusted accordingly. It would also be possible to arrange the valves and outlet ports in a cylindrical array but not in straight lines. Moreover the expression "imaginary cylindrical surface" as used herein is not intended to exclude the possibility that there might be an actual physical surface at the same location and it will be appreciated that the manifold block could be machined with a cylindrical surface containing the valve ports. It is accordingly to be understood that the invention is in no way limited to the details of the illustrated construction and that many modifications and variations will fall within the scope of the appended claims.

I claim:

1. A fluid flow manifold having at one side a plurality of fluid outlets and at an opposing side a plurality of valve outlet ports each connected to one of the fluid outlets by a respective outlet duct, wherein: said fluid outlets are disposed in a linear array; said valve outlet ports are disposed in an array spreading circumferentially and longitudinally over an imaginary cylindrical surface curved about an axis of curvature extending longitudinally of the linear array of fluid outlets in the vicinity of those outlets;

each pair of valve outlet ports connected to a successive pair of said fluid outlets are spaced apart both longitudinally and circumferentially of said imaginary cylindrical surface, whereby they are spaced apart at a distance which is greater than the distance between said successive pair of said fluid outlets; and said outlet ducts extend from the valve outlet ports radially of said imaginary cylindrical surface so as to converge into a linear array defining the fluid outlets such that the lengths of all outlet ducts between the valve outlet ports and the fluid outlets are substantially equal.

2. A fluid flow manifold as claimed in claim 1, wherein said valve outlet ports are disposed in a plurality of lines each generally parallel with the linear array of fluid outlets and lying on said imaginary cylindrical surfaces and wherein the fluid outlets are successively connected by the outlet ducts to the outlet ports in successive lines so that the spacing between the valve outlet ports in each said line is greater than the spacing between the fluid outlets for said linear array.

3. A fluid flow manifold having at one side a plurality of fluid outlets and at an opposing side a plurality of valve outlet ports each connected to one of the fluid outlets by a respective outlet duct, wherein:

said fluid outlets are disposed in a linear array;

said valve outlet ports are disposed in an array spreading circumferentially and longitudinally over an imaginary cylindrical surface curved about an axis of curvature extending longitudinally of the linear array of fluid outlets in the vicinity of those outlets;

said outlet ducts extend from the valve outlet ports radially of said imaginary cylindrical surface so as to converge into a linear array defining the fluid outlets such that the lengths of all outlet ducts between the valve outlet ports and the fluid outlets are substantially equal; and said manifold further comprises a fluid supply duct extending parallel with the linear array of fluid outlets between those outlets and the array of valve outlet ports, and a plurality of fluid transfer ducts radiating out from the supply duct to valve inlet ports adjacent the valve outlet ports.

4. A fluid flow manifold as claimed in claim 3 wherein at least some of the fluid outlet ducts comprise tubes passing laterally through the fluid supply duct.

5. A fluid flow manifold as claimed in claim 3 wherein said outlet ducts extend through a manifold body block such that said fluid outlets are spaced along a side face of the body block and said valve outlet ports are disposed at the bases of valve chambers formed in a side of the body block opposed to said side face.

6. A fluid flow manifold as claimed in claim 5 wherein said valve chambers are closed by valve structures fastened to said side of the body block and including valve members to open and close said valve outlet ports.

7. A fluid flow manifold as claimed in claim 5 wherein said side of the block is formed with a plurality of flat elongate side faces extending longitudinally of said imaginary cylindrical surface and laterally inclined to one another so as to follow the curvature of said imaginary cylindrical surface and said valve chambers defined by blind holes in said elongate side faces.

8. A fluid flow manifold having at one side a plurality of valve outlet ports each connected to one of the fluid outlets by a respective outlet duct extending through the body block, wherein:

said fluid outlets are spaced in a linear array along one side of the body block;

the body block is formed with a plurality of flat elongate side faces which are generally opposed to said one side face and which extend longitudinally of an imaginary cylindrical surface curved about an axis of curvature extending longitudinally of the linear array of fluid outlets in the vicinity of those outlets, said elongate side faces being laterally inclined to one another so as to follow the curvature of said imaginary surface;

said valve outlets are disposed in lines extending along said flat side faces of the body block and at the bases of valve chambers formed as blind holes in those faces;

said outlet ducts extend from the valve outlet ports radially of said imaginary cylindrical surface so as to converge into a linear array defining the fluid outlets such that the lengths of the outlet ducts between the valve outlet ports and the fluid outlets are substantially equal;

a fluid supply duct extends through the body block parallel with the linear array of fluid outlets; and a plurality of fluid transfer ducts radiate out from the fluid supply duct to valve inlet ports in the bases of the valve chambers.

9. A fluid flow manifold as claimed in claim 8, wherein said valve chambers are closed by valve structures fastened to said flat side faces of the body block and including valve plungers actuable to open and close said valve outlet ports.

* * * * *